US008746845B2

(12) United States Patent
Kodoi

(10) Patent No.: US 8,746,845 B2
(45) Date of Patent: Jun. 10, 2014

(54) LIQUID EJECTION HEAD, AND RECORDING METHOD AND SUCTION METHOD USING THE LIQUID EJECTION HEAD

(71) Applicant: Canon Kabushiki Kaisha, Tokyo (JP)

(72) Inventor: Takuma Kodoi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/684,855

(22) Filed: Nov. 26, 2012

(65) Prior Publication Data

US 2013/0141490 A1 Jun. 6, 2013

(30) Foreign Application Priority Data

Dec. 2, 2011 (JP) ..... 2011-264526

(51) Int. Cl.
*B41J 2/135* (2006.01)

(52) U.S. Cl.
USPC ..... 347/44

(58) Field of Classification Search
CPC ..... B41J 2/44; B41J 2/16; B41J 2/165; B41J 2/17563; B41J 2/135; B41J 2/19; B41J 2/20; B41J 2/14467; B41J 2/14403; B41F 31/02; B41F 15/40; B41M 1/12
USPC ..... 347/44
See application file for complete search history.

(56) References Cited

U.S. PATENT DOCUMENTS 7,591,531 B2 9/2009 Tsuchii et al.
2008/0246813 A1 10/2008 Marukami et al.

FOREIGN PATENT DOCUMENTS

JP 2008-254304 A 10/2008
JP 2009-39914 A 2/2009

*Primary Examiner* — Alessandro Amari
*Assistant Examiner* — Michael Konczal
(74) *Attorney, Agent, or Firm* — Fitzpatrick, Cella, Harper & Scinto

(57) ABSTRACT

A liquid ejection head includes a substrate, a pressure chamber, first and second common liquid chambers, a filter for inhibiting inflow of foreign matter in liquid supplied to the pressure chamber, first and second supply openings respectively communicating with the first and second common liquid chambers, and a liquid receiving portion formed on an opposite surface of the substrate. The second common liquid chamber, the pressure chamber, and the first common liquid chamber are arranged in the listed order in a direction from an end of the substrate to a center of the substrate. The first common liquid chamber communicates with the pressure chamber via the filter, and the second common liquid chamber communicates with the pressure chamber through no filter.

10 Claims, 17 Drawing Sheets

LIQUID EJECTION HEAD, AND RECORDING METHOD AND SUCTION METHOD USING THE LIQUID EJECTION HEAD

BACKGROUND OF THE INVENTION

1. Field of the Invention

The present invention relates to a liquid ejection head for ejecting liquid such as ink, and a recording method and a suction method using the liquid ejection head.

2. Description of the Related Art

As a liquid ejection head (hereinafter simply referred to as recording head) used in a liquid ejection apparatus, one in which an orifice plate is bonded to a substrate having a supply opening formed therein is manufactured in high volume. An exemplary structure of such a recording head is described with reference to FIGS. 19A and 19B.

FIG. 19A is a plan view of a related recording head seen from a direction of ink ejection, and FIG. 19B is a sectional view of the recording head taken along the line 19B-19B of FIG. 19A. As illustrated in FIGS. 19A and 19B, a recording head 1 includes a substrate 2, an orifice plate 3, and a common liquid chamber 4 formed by bonding the substrate 2 and the orifice plate 3 together.

A liquid receiving portion 5 for receiving ink from an ink tank (not shown) as an ink supply source is provided on a surface of the substrate 2 on a side opposite to the side bonded to the orifice plate 3. The liquid receiving portion 5 has a supply opening 6 formed therein which communicates to the common liquid chamber 4. Ink supplied to the liquid receiving portion 5 is supplied through the supply opening 6 to the common liquid chamber 4.

Multiple ejection orifices 7 for ejecting ink are formed in the orifice plate 3 so as to sandwich the common liquid chamber 4 therebetween. Pressure chambers 8 are formed between the substrate 2 and the orifice plate 3 in regions corresponding to the respective ejection orifices 7. An energy generating element 9 such as a heater for supplying ejection energy to ink in each pressure chamber 8 is provided in each pressure chamber 8. Each pressure chamber 8 communicates through a flow path 10 to the common liquid chamber 4, and ink in the common liquid chamber 4 is supplied through the flow path 10 to each pressure chamber 8.

Further, the recording head 1 includes, in the ink path from the common liquid chamber 4 to each pressure chamber 8, a filter 11 for trapping foreign matter in ink. Ink in the ink tank may contain foreign matter. If foreign matter together with ink flows into the pressure chamber 8 and attaches to the ejection orifice 7, the ejection orifice 7 is clogged and ink is prevented from being ejected. The filter 11 may prevent foreign matter from flowing into the pressure chamber 8, and may inhibit clogging of the ejection orifice 7.

Next, ink flow from the supply opening 6 to the pressure chamber 8 is described with reference to FIGS. 20A and 20B. FIGS. 20A and 20B are sectional views of a recording head having multiple common liquid chambers 4 and supply openings 6 taken along a line passing through the common liquid chambers 4, the supply openings 6, and the ejection orifices 7. Note that, a suction cap 12 for sucking ink from the ejection orifices 7 is mounted onto the recording head illustrated in FIGS. 20A and 20B.

The supply opening 6 is connected to an ink tank (not shown) as an ink supply source, and ink is supplied from the ink tank through the supply opening 6, the common liquid chamber 4, and the flow path 10 to the pressure chamber 8.

Ink in the pressure chamber 8 receives ejection energy from the energy generating element 9 and flows out from the ejection orifice 7. As illustrated in FIG. 20A, ink in the pressure chamber 8 flows out from the ejection orifice 7 also with the help of the suction cap 12. When ink in the pressure chamber 8 decreases in quantity, ink is supplied again from the ink tank through the supply opening 6 and the like to the pressure chamber 8.

As illustrated in FIG. 20B, ink supplied to each pressure chamber 8 is supplied through only one flow path 10. Therefore, in the recording head illustrated in FIGS. 19A and 19B or FIGS. 20A and 20B, refill characteristics (characteristics represented as time from a point at which ink flows out of the ejection orifice 7 to a point at which the pressure chamber 8 is filled with ink) are not always sufficient. Accordingly, a recording head with improved refill characteristics has been proposed.

In a recording head disclosed in Japanese Patent Application Laid-Open No. 2008-254304, multiple common liquid chambers communicating to one supply opening are formed so as to sandwich their pressure chamber. A flow path is formed from each of two common liquid chambers sandwiching one pressure chamber to the pressure chamber. Ink is supplied from two common liquid chambers through the flow paths to one pressure chamber, and thus, the ink refill characteristics are improved.

In the recording head described in Japanese Patent Application Laid-Open No. 2008-254304, ink is supplied through one supply opening to a pressure chamber, and thus, there is a ceiling on improvement in the ink refill characteristics. In particular, when printing is carried out at high speed in a higher duty cycle, more ink is required to be supplied to the pressure chamber, and thus, refilling the pressure chamber with ink sometimes becomes too late.

Japanese Patent Application Laid-Open No. 2009-039914 discloses a recording head having higher refill characteristics than those of the recording head described in Japanese Patent Application Laid-Open No. 2008-254304.

Specifically, in the recording head described in Japanese Patent Application Laid-Open No. 2009-039914, multiple supply openings are formed correspondingly to common liquid chambers formed so as to sandwich pressure chambers. A flow path is formed from each of two common liquid chambers sandwiching one pressure chamber to the pressure chamber, and thus, ink is supplied through two supply openings, two common liquid chambers, and two flow paths to one pressure chamber. Therefore, the recording head described in Japanese Patent Application Laid-Open No. 2009-039914 has improved ink refill characteristics compared with the recording head described in Japanese Patent Application Laid-Open No. 2008-254304.

However, in the recording head disclosed in Japanese Patent Application Laid-Open No. 2009-039914, multiple liquid receiving portions are formed correspondingly to the supply openings, and an ink flow path is formed from an ink tank to each liquid receiving portion. Therefore, foreign matter contained in ink in the ink tank may pass through all the supply openings. In other words, foreign matter, together with ink, may flow in all the common liquid chambers. Therefore, it is necessary to provide a filter in every ink path from the common liquid chambers to the pressure chambers.

As illustrated in FIGS. 19A and 19B, when the filter 11 is provided in the recording head 1, space for providing the filter 11 is required to be secured on the substrate 2. It follows that, as the number of the filters 11 increases, the substrate 2 is required to be larger.

As the substrate becomes larger, the number of substrates which may be taken from one wafer in the manufacturing of the recording head becomes smaller, which results in an increase in manufacturing cost of the recording head. Further, as the substrate becomes larger, the orifice plate also becomes larger accordingly and the recording head becomes larger. As a result, the liquid ejection apparatus as a whole becomes larger. When a suction cap is provided for the liquid ejection apparatus, as the recording head becomes larger, the suction cap also becomes larger.

In particular, when the colors of ink ejected from the recording head increase, the number of the ejection orifices and the number of the pressure chambers increase so that the substrate becomes still larger, and thus, the manufacturing cost of the recording head conspicuously increases and the liquid ejection apparatus conspicuously becomes larger.

SUMMARY OF THE INVENTION

According to an exemplary embodiment of the present invention, there is provided a liquid ejection head, including: a substrate provided with an energy generating element for generating energy used for ejecting liquid; a pressure chamber formed on a first surface side of the substrate having the energy generating element formed thereon, the pressure chamber communicating to an ejection orifice for ejecting liquid; a first common liquid chamber formed on the first surface side of the substrate, for supplying liquid to the pressure chamber; a filter formed between the pressure chamber and the first common liquid chamber, for inhibiting inflow of foreign matter in liquid supplied to the pressure chamber; a second common liquid chamber formed on a side opposite to the side on which the first common liquid chamber is formed with respect to the pressure chamber, for supplying liquid to the pressure chamber; a first supply opening formed in a second surface which is on an opposite side to the first surface of the substrate, the first supply opening communicating to the first common liquid chamber; a second supply opening formed in the second surface of the substrate, the second supply opening communicating to the second common liquid chamber; and a liquid receiving portion formed in the second surface of the substrate so as to communicate to both the first supply opening and the second supply opening, the liquid receiving portion receiving liquid from outside of the substrate, in which the second common liquid chamber, the pressure chamber, and the first common liquid chamber are arranged in this order in a first direction from an end of the substrate to a center of the substrate, and in which the first common liquid chamber communicates to the pressure chamber via the filter, and the second common liquid chamber communicates to the pressure chamber not via the filter.

Further features of the present invention will become apparent from the following description of exemplary embodiments with reference to the attached drawings.

DESCRIPTION OF THE EMBODIMENTS

Embodiments are described in the following with reference to the attached drawings.

(First Embodiment)

First, a first embodiment of the present invention is described with reference to FIGS. 1A to 5C.

Figure 1A:
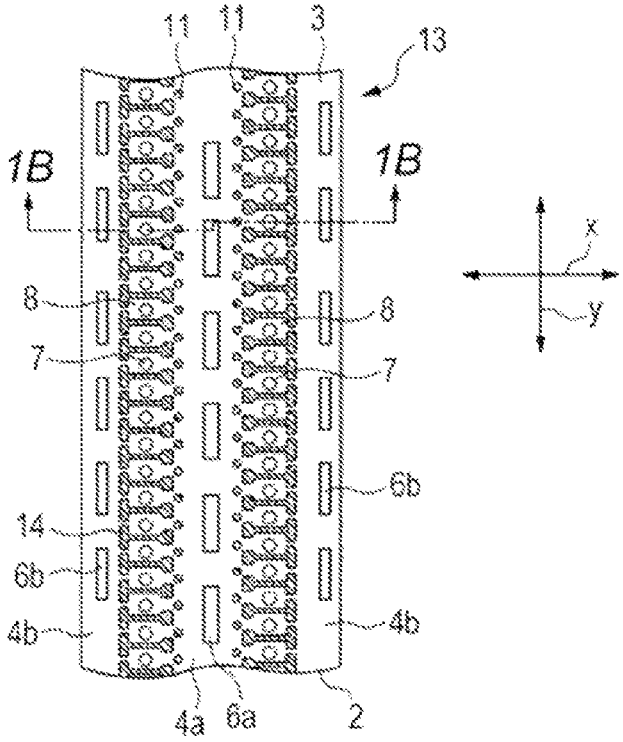
FIGS. 1A and 1B are a schematic plan view and a sectional view, respectively, of a recording head according to a first embodiment of the present invention.
Figure 1B:
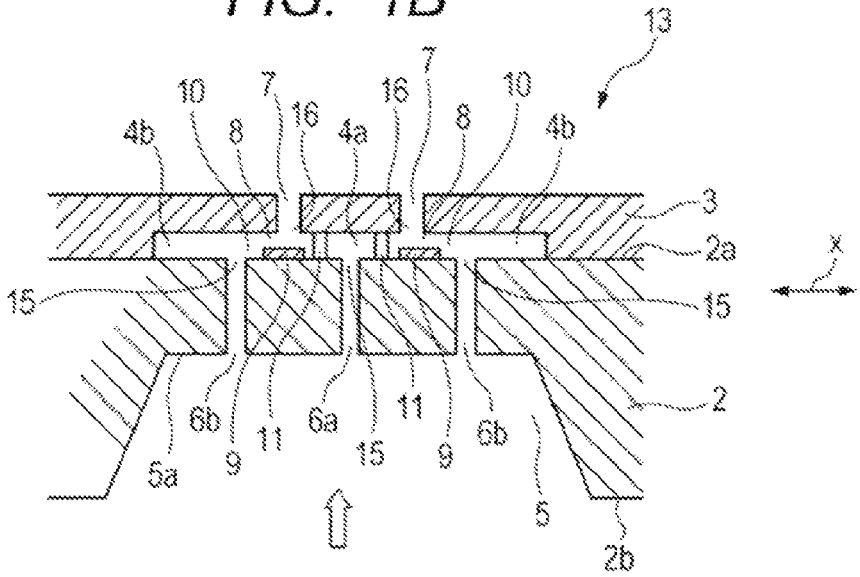

FIG. 1A is a schematic plan view of a liquid ejection head (hereinafter referred to as recording head) according to this embodiment seen from a direction of ink ejection, and FIG. 1B is a sectional view of the recording head taken along the line 1B-1B of FIG. 1A. As illustrated in FIGS. 1A and 1B, a recording head 13 according to this embodiment includes a substrate 2 and multiple pressure chambers 8 formed on a surface of the substrate 2 by bonding an orifice plate 3 to the substrate 2.

The multiple pressure chambers 8 form lines along one predetermined direction (hereinafter referred to as first direction X) in parallel with a surface of the substrate 2 to which the orifice plate 3 is bonded (hereinafter referred to as substrate front surface 2*a*) and lines along a second direction Y which is in parallel with the substrate front surface 2*a* and which intersects the first direction X. In this embodiment, two pressure chambers 8 are arranged along the first direction X, but three or more pressure chambers 8 may be arranged along the first direction X.

An energy generating element 9 for generating energy for ejecting ink is provided in each pressure chamber 8. Exemplary energy generating elements 9 include an electrothermal conversion element (heater) which generates heat when energized and a piezoelectric element which generates pressure to give ejection energy to ink.

An ejection orifice 7 for communicating the pressure chamber 8 to the atmosphere is formed in the orifice plate 3 at a portion corresponding to the pressure chamber 8. Ink in the pressure chamber 8 is given ejection energy by the energy generating element 9 to be ejected through the ejection orifice 7.

A first common liquid chamber 4*a* communicating to pressure chambers 8 arranged side by side in the first direction X via flow paths 10 is provided between the pressure chambers 8 arranged side by side in the first direction X. Further, second common liquid chambers 4*b* communicating to the adjacent pressure chambers 8 via flow paths 10 are provided outside the pressure chamber 8 in the first direction X.

In this embodiment, partition walls 14 are provided in space formed between the substrate 2 and the orifice plate 3 along the first direction X and the second direction Y to partition the space. The partition walls 14 form the pressure chambers 8, the first and second common liquid chambers 4*a* and 4*b*, and the flow paths 10 between the substrate 2 and the orifice plate 3. The provision of the ejection orifice 7 and the energy generating element 9 in the pressure chamber 8 enables more efficient ink ejection.

A liquid receiving portion 5 for receiving ink from the outside of the substrate 2, for example, from an ink tank (not shown) as an ink supply source, is provided on a surface of the substrate 2 which is opposite to the substrate front surface 2*a* (hereinafter referred to as substrate rear surface 2*b*).

In a surface 5*a* of the liquid receiving portion 5 located in an ink flow direction, first supply openings 6*a* located around the center of the surface 5*a* and second supply openings 6*b* located around ends of the surface 5*a* are formed. More specifically, the liquid receiving portion 5 is formed so as to communicate to both the first and second supply openings 6*a* and 6*b*.

The first supply opening 6*a* communicates to the first common liquid chamber 4*a* while the second supply opening 6*b* communicates to the second common liquid chamber 4*b*. Ink in the ink tank flows from the liquid receiving portion 5 through the first and second supply openings 6*a* and 6*b* into the first and second common liquid chambers 4*a* and 4*b*, respectively.

Figure 2:
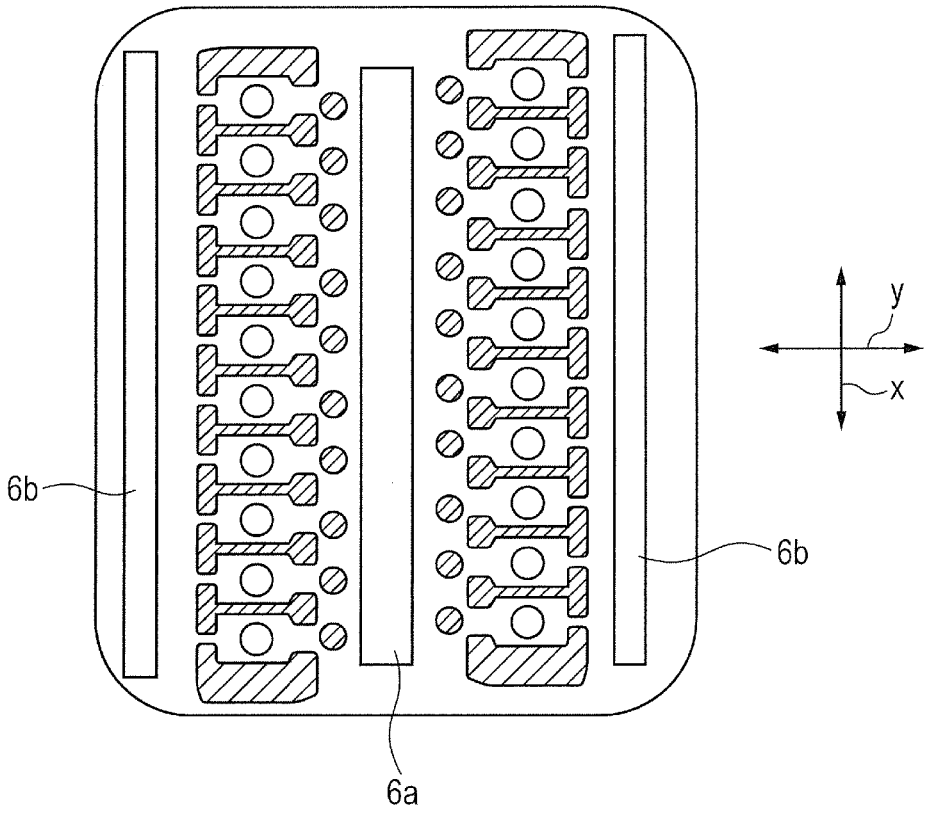
FIG. 2 is a schematic plan view illustrating another example of the recording head according to the first embodiment of the present invention.

In this embodiment, the first and second supply openings 6*a* and 6*b* are in a rectangular shape and multiple first supply openings 6*a* and multiple second supply openings 6*b* are arranged along the second direction Y. However, the numbers and the shapes of the first and second supply openings 6*a* and 6*b* are not limited thereto. For example, as illustrated in FIG. 2, it is also possible that multiple first and second supply openings 6*a* and 6*b* are not arranged in the second direction Y.

Portions communicating between the first supply openings 6*a* and the first common liquid chambers 4*a* and portions communicating between the second supply openings 6*b* and the second common liquid chambers 4*b* are referred to as supply opening communicating portions 15. Further, portions communicating between the pressure chambers 8 and the ejection orifices 7 are referred to as ejection orifice communicating portions 16. In the sectional view taken along the line 1B-1B, the recording head 13 has two ejection orifice communicating portions 16 among three supply opening communicating portions 15.

Further, the recording head 13 includes filters 11 for trapping foreign matter contained in ink. The filters 11 are provided in the common liquid chambers 4 so as to support the substrate 2 and the orifice plate 3.

The filters 11 may inhibit entrance of foreign matter such as dust into regions around the ejection orifices 7 and the energy generating elements 9 together with ink. As a result, ink ejection failure due to clogging of the ejection orifices 7 by foreign matter is inhibited. Further, the filters 11 bear a load applied between the orifice plate 3 and the substrate 2 to improve the strength of the recording head 13.

The filter 11 is provided in an ink path from the first common liquid chamber 4*a* to the pressure chamber 8, and is not provided in an ink path from the second common liquid chamber 4*b* to the pressure chamber 8. The filter 11 is provided in this way because ink which passes through the first supply opening 6*a* contains foreign matter but ink which passes through the second supply opening 6*b* contains almost no foreign matter.

Figure 3A:
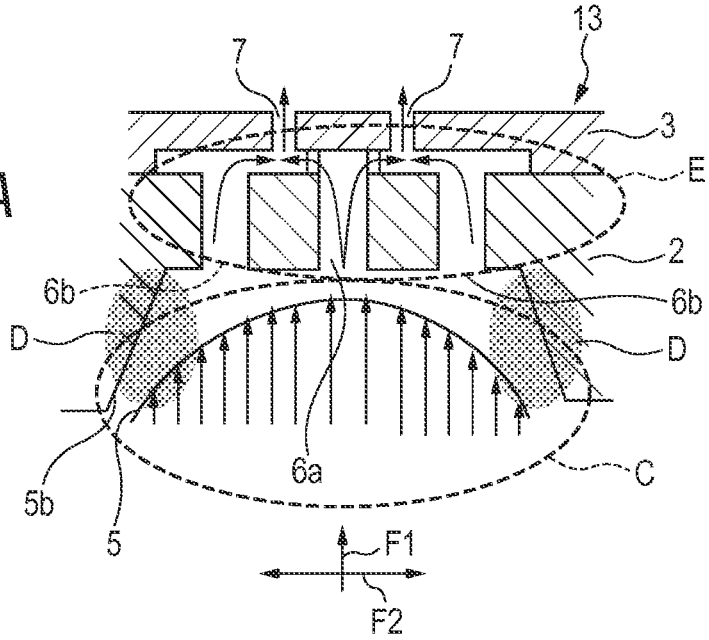
FIG. 3A illustrates flow velocity distribution of ink in the recording head.
Figure 3B:
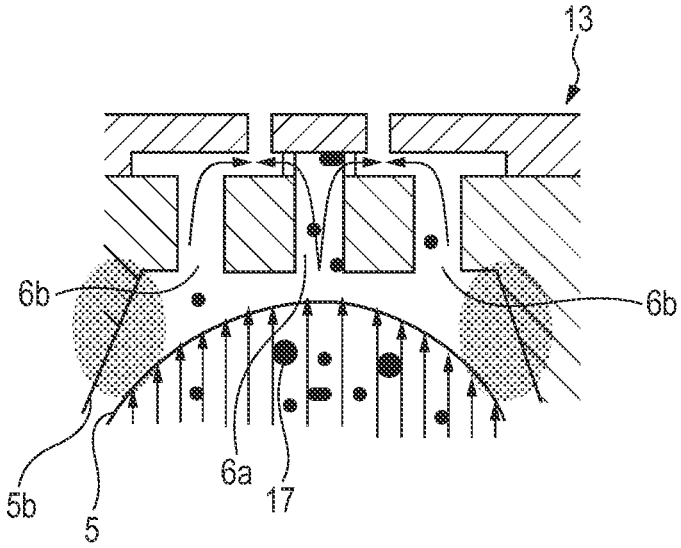
FIG. 3B is a schematic view illustrating how foreign matter moves according to the flow velocity distribution.

The reason that ink which passes through the second supply opening 6*b* contains almost no foreign matter is described with reference to FIGS. 3A, 3B, and 4. FIG. 3A illustrates flow velocity distribution of ink in the recording head 13. FIG. 3B is a schematic view illustrating how foreign matter moves according to the flow velocity distribution of ink illustrated in FIG. 3A.

When suction operation of ink from the ejection orifices 7, high duty cycle printing, or high speed printing is carried out, the flow velocity vectors of ink are distributed as illustrated in FIG. 3A. In a portion C in FIG. 3A, flow velocity distribution of ink in the liquid receiving portion 5 is schematically illustrated, and a longer arrow represents higher ink flow velocity.

A wall 5*b* located in a flow path from the ink tank to the liquid receiving portion 5 in a flow intersecting direction F2 orthogonal to an ink flow direction F1 acts as an ink flow resistance. Therefore, in a region D in proximity to the wall 5*b*, the flow resistance value is relatively large. Therefore, as illustrated in FIGS. 3A and 3B, the ink flow velocity is relatively low in the region D in proximity to the wall 5*b*, and is the highest around the center of the liquid receiving portion 5 in the flow intersecting direction F2.

A portion E in FIG. 3A schematically illustrates ink flow from the first and second supply openings 6*a* and 6*b* to the pressure chambers 8, and a larger number of arrows represents higher flow velocity.

Ink which passes through the first supply opening 6*a* flows into two pressure chambers 8, and ink which passes through the second supply opening 6*b* flows into one pressure chamber 8. Therefore, the amount of ink which passes through the first supply opening 6*a* is larger than the amount of ink which passes through the second supply opening 6*b*.

Figure 4:
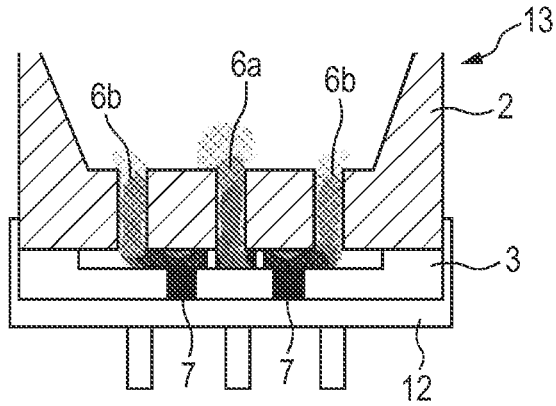
FIG. 4 illustrates the result of a simulation of flow velocity distribution of ink when ink is sucked from an ejection orifice side.

FIG. 4 illustrates the result of a simulation of flow velocity distribution of ink when ink is sucked from the ejection orifice 7 side. Higher density represents higher ink flow velocity. As illustrated in FIG. 4, the flow velocity of ink which passes through the first supply opening 6*a* is higher than the flow velocity of ink which passes through the second supply opening 6*b*. The flow velocity of ink which passes through the first supply opening 6*a* is up to twice as high as the flow velocity of ink which passes through the second supply opening 6*b*.

The first supply opening 6*a* is located around the center of the surface 5*a* of the liquid receiving portion 5 in the ink flow direction F1, and thus, the ink flow velocity becomes higher around the center of the liquid receiving portion 5 in the flow intersecting direction F2.

The amount of foreign matter 17 which is brought from the ink tank together with ink becomes larger as the ink flow velocity is higher. Therefore, foreign matter 17 which is relatively large enough to clog the ejection orifices 7 gathers around the center of the flow paths in the flow intersecting direction F2, and is more likely to pass through the first supply opening 6*a* and almost no foreign matter 17 passes through the second supply opening 6*b*. In particular, foreign matter which has a relatively large diameter, mass, specific gravity, or the like and which does not disperse in ink is more likely to pass through the first supply opening 6*a*.

In this way, almost no foreign matter is contained in ink which passes through the second supply opening 6*b*, and thus, without provision of the filter 11 in the ink path from the second common liquid chamber 4*b* to the pressure chamber 8, the inflow of the foreign matter 17 into the pressure chamber 8 is inhibited.

As described above, no filter is provided in the ink path from the second common liquid chamber 4*b* to the pressure chamber 8, and thus, the supply opening communicating portion 15 between the second supply opening 6*b* and the second common liquid chamber 4*b* may be closer to the pressure chamber 8 by the space to be occupied by the filter. Therefore, compared with a case of a recording head in which a filter is required in every ink path from the common liquid chambers to the pressure chambers, the size of the substrate 2 may be reduced.

For example, in the recording head 13 illustrated in FIGS. 1A and 1B or FIG. 2 in which two pressure chambers 8 are arranged along the first direction X, when the filter is in the shape of a circular cylinder having a diameter of 10 μm, two filters may be eliminated along the first direction X, and thus, the size of the substrate 2 may be reduced by 20 μm. In a recording head having pressure chambers for ejecting multiple colors of ink formed therein in the first direction X, multiple second supply openings 6*b*, multiple second common liquid chambers 4*b*, and multiple liquid receiving portions 5 are also arranged along the first direction X, and thus, the size of the substrate 2 may be further reduced.

However, in a structure which simply eliminates the filter 11, there is a possibility that only one of the two flow paths 10 communicating to the pressure chamber 8 has a small flow resistance value. As a result, imbalances may be caused in bubbling for ejecting ink to form unsatisfactory ink droplets and to cause landing failure of ejected ink droplets at a desired location. Therefore, in order to acquire symmetrical bubbling and high image quality, it is more preferred to set the flow resistance value from the first supply opening 6*a* to the ejection orifice 7 and the flow resistance value from the second supply opening 6*b* to the ejection orifice 7 to be the same.

Note that, "flow resistance value" as used herein refers to the value of resistance which acts on ink while the ink passes from the first and second supply openings 6*a* and 6*b* through the flow paths 10 to one pressure chamber 8.

Figure 5A:
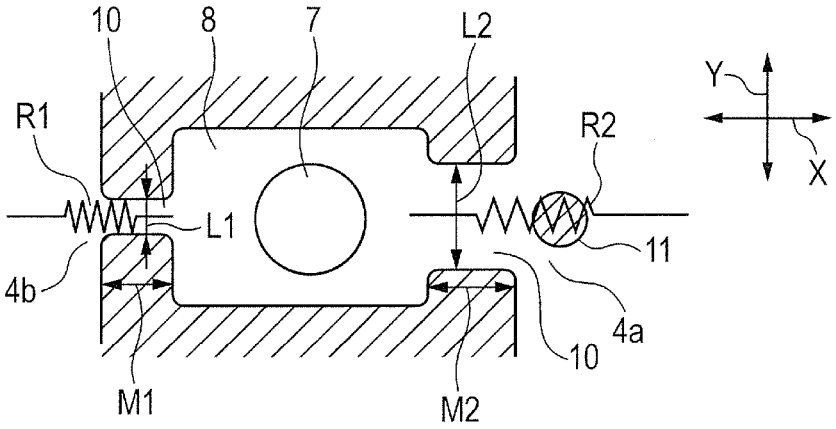
FIGS. 5A, 5B, and 5C are enlarged views illustrating examples of portions around a pressure chamber and flow paths of the recording head.
Figure 5B:
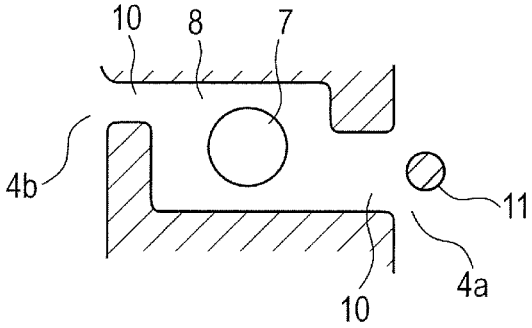
Figure 5C:
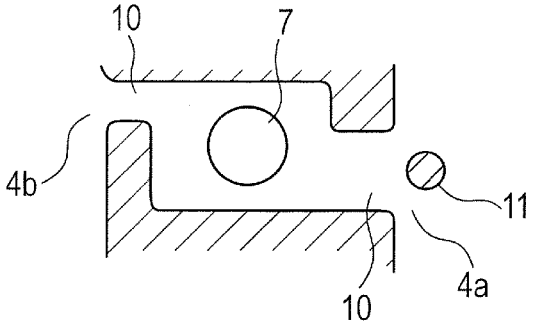

A structure which may set the flow resistance value from the first supply opening 6*a* to the ejection orifice 7 and the flow resistance value from the second supply opening 6*b* to the ejection orifice 7 to be the same is described with reference to FIGS. 5A to 5C. FIGS. 5A to 5C are enlarged views illustrating examples of the pressure chamber 8 and the flow paths 10 of the recording head 13. Note that, FIG. 5A also illustrates resistor symbols for representing flow resistances.

The flow resistance value changes depending on the size of the flow path 10 in a direction perpendicular to the ink flow (hereinafter referred to as flow path width). As illustrated in FIG. 5A, a flow path width L1 of the flow path 10 on a side on which the filter 11 is not provided is smaller than a flow path width L2 of the flow path 10 on a side on which the filter 11 is provided. As the flow path width becomes smaller, the flow resistance value becomes larger, and thus, a flow resistance value R1 of ink which flows from the flow path 10 on the side on which the filter 11 is not provided into the pressure chamber 8 is equal to a flow resistance value R2 of ink which flows from the flow path 10 on the side on which the filter 11 is provided into the pressure chamber 8.

The flow resistance value also changes depending on the size of the flow path 10 in a direction along the ink flow (hereinafter referred to as flow path length). For example, by setting a flow path length M1 of the flow path 10 on the side on which the filter 11 is not provided to be longer than a flow path length M2 of the flow path 10 on the side on which the filter 11 is provided, the flow resistance value R1 and the flow resistance value R2 may be set to be the same.

However, as the flow path length M1 becomes longer, the size of the substrate 2 in the first direction X increases accordingly. Therefore, in order to reduce the size of the substrate 2, it is preferred to set the flow resistance value R1 and the flow resistance value R2 to be the same by reducing the flow path width L1.

Further, in the recording head in which the flow resistance value R1 is increased by reducing the flow path width L1, the flow path length M1 becomes shorter, and the composition (in particular, moisture content) of ink in the second common liquid chamber 4*b* and the composition of ink in the pressure chamber 8 are easy to be the same. Therefore, even when liquid ejected from the ejection orifice 7 is a small liquid droplet of 2 pl or 1 pl, such a recording head is also advantageous from the viewpoint of initial ejection property. Initial ejection property is deteriorated by evaporation of moisture in ink in the pressure chamber 8.

Note that, the shapes of the flow paths 10 are not limited to those illustrated in FIG. 5A, and, it is enough that, as illustrated in FIGS. 5B and 5C, one or more flow paths 10 are formed from the first and second common liquid chambers 4*a* and 4*b* to one pressure chamber 8.

Figure 6:
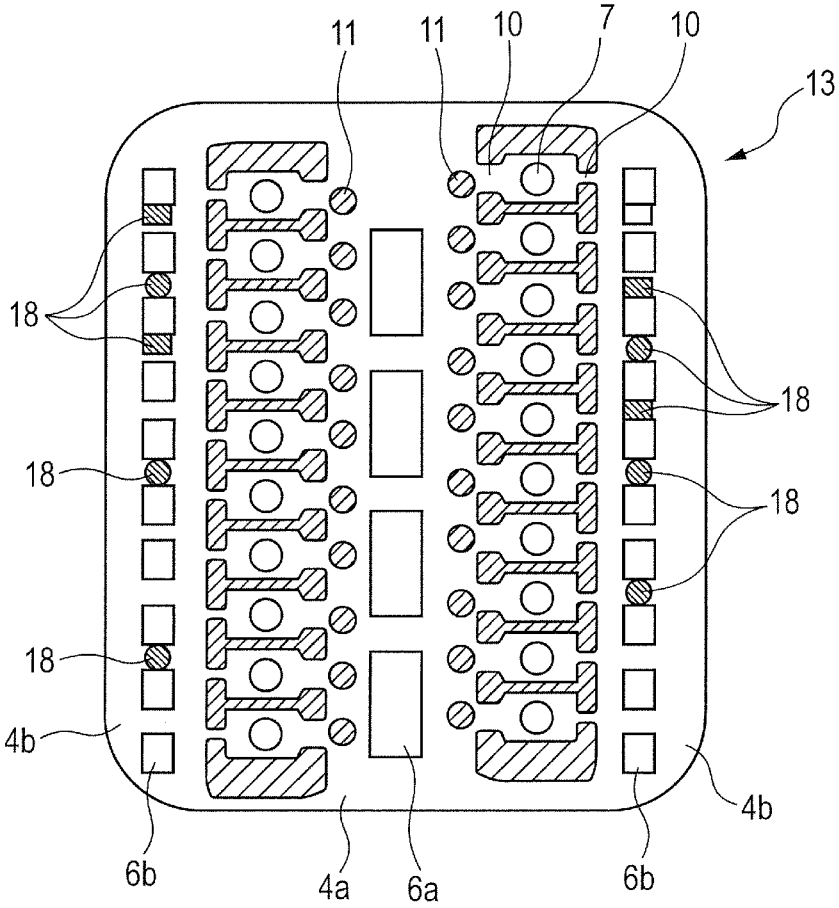
FIG. 6 is a schematic plan view of a recording head including anti-peeling off columns.

Further, as illustrated in FIG. 6, a column for preventing peeling off of the orifice plate 3 from the substrate 2 (hereinafter referred to as anti-peeling off column 18) may be provided in proximity to the supply opening communicating portion 15 between the second supply opening 6*b* and the second common liquid chamber 4*b*. FIG. 6 is a schematic plan view of the recording head 13 including the anti-peeling off columns 18.

The anti-peeling off columns 18 are formed integrally with the orifice plate 3, and tip surfaces of the anti-peeling off columns 18 are bonded to the substrate front surface 2*a*. Therefore, the anti-peeling off columns 18 support the substrate 2 and the orifice plate 3, and the bonding force between the substrate 2 and the orifice plate 3 is improved even at portions without the filters 11. As a result, the orifice plate 3 is less liable to be peeled off from the substrate 2.

In particular, force is applied to the substrate 2 in manufacturing the recording head 13 and during printing operation of the recording head 13 to cause stress between the substrate 2 and the orifice plate 3, resulting in that the orifice plate 3 becomes liable to be peeled off from the substrate 2. The anti-peeling off columns 18 prevent the orifice plate 3 from easily peeling off from the substrate 2.

In second to ninth embodiments of the present invention below, description is given of structures of the recording head which has a larger difference between the flow velocity of ink which passes through the second supply opening 6*b* and the flow velocity of ink which passes through the first supply opening 6*a*, and recording methods and suction methods which may increase the flow velocity difference. The anti-peeling off columns 18 may also be applied to the second to ninth embodiments.

(Second Embodiment)

A recording head according to the second embodiment of the present invention is described with reference to FIGS. 7A and 7B.

In the recording head 13 according to the first embodiment (FIGS. 1A and 1B), two pressure chambers 8 are arranged along the first direction X, but, in the recording head, the number of the pressure chambers 8 arranged along the first direction X is not limited to two. The recording head according to the second embodiment has three or more pressure chambers 8 arranged along the first direction X.

Figure 7A:
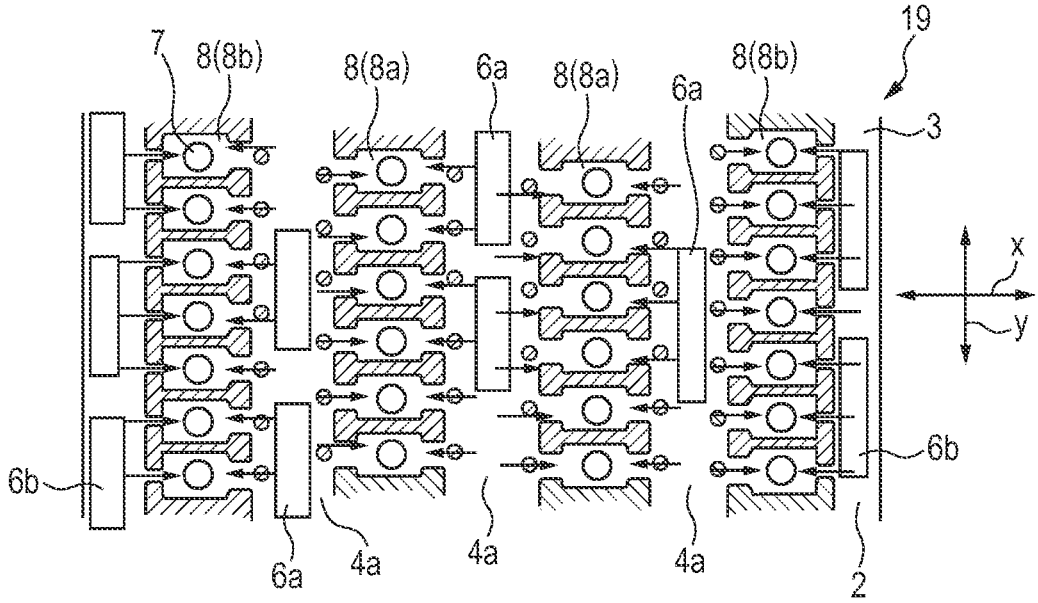
FIG. 7A is a schematic plan view of a recording head according to a second embodiment of the present invention.
Figure 7B:
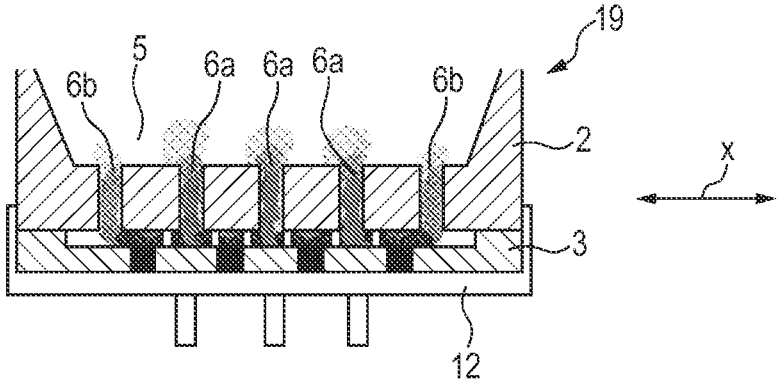
FIG. 7B is a sectional view illustrating flow velocity distribution during suction operation of the recording head.

FIG. 7A is a schematic plan view of the recording head according to this embodiment seen from a direction of ink ejection, and FIG. 7B is a sectional view of the recording head. Note that, arrows in FIG. 7A represent ink flow from the first and second common liquid chambers 4*a* and 4*b* to the pressure chambers 8. Further, FIG. 7B also illustrates the result of a simulation of flow velocity distribution of ink when ink is sucked from the ejection orifice 7 side. Higher density represents higher flow velocity.

As illustrated in FIG. 7A, a recording head 19 according to this embodiment includes four pressure chambers 8 arranged along the first direction X. Therefore, there are three first common liquid chambers 4*a* arranged along the first direction X, each of which is provided between pressure chambers 8 side by side in the first direction X. In addition, there are three first supply openings 6*a* arranged along the first direction X, each of which communicates to the first common liquid chamber 4*a*.

The second common liquid chambers 4*b* are, in the first direction X, provided outside the pressure chambers 8 located at both ends in the first direction X. Specifically, there are five first and second common liquid chambers 4*a* and 4*b* in total arranged along the first direction X.

The second supply openings 6*b* communicating to the second common liquid chambers 4*b* are also formed in the substrate 2, and there are five first and second supply openings 6*a* and 6*b* in total arranged in the liquid receiving portion 5 along the first direction X.

As illustrated in FIG. 7B, even when there are three or more pressure chambers 8, a difference occurs between the flow velocity of ink which passes through the first supply opening 6*a* and the flow velocity of ink which passes through the second supply opening 6*b*.

Further, in the recording head 19 including three or more pressure chambers 8 arranged along the first direction X, by adjusting the amount of ink to be ejected or sucked from the pressure chambers 8 as in the following, the difference in ink flow velocity through the first and second supply openings 6*a* and 6*b* is increased.

The total amount of ink which flows out of the pressure chambers 8 other than those located at both ends in the first direction X (hereinafter referred to as intermediate pressure chambers 8*a*) is set to be larger than the total amount of ink which flows out of the pressure chambers 8 located at both ends in the first direction X (hereinafter referred to as both-end pressure chambers 8*b*). By adjusting the amounts of ink which flows out of the intermediate pressure chambers 8*a* and the both-end pressure chambers 8*b* in this way, the flow velocity of ink which flows from the second supply openings 6*b* toward the pressure chambers 8*b* becomes lower, and ink in the liquid receiving portion 5 is more likely to flow into the first supply openings 6*a*.

Figure 8:
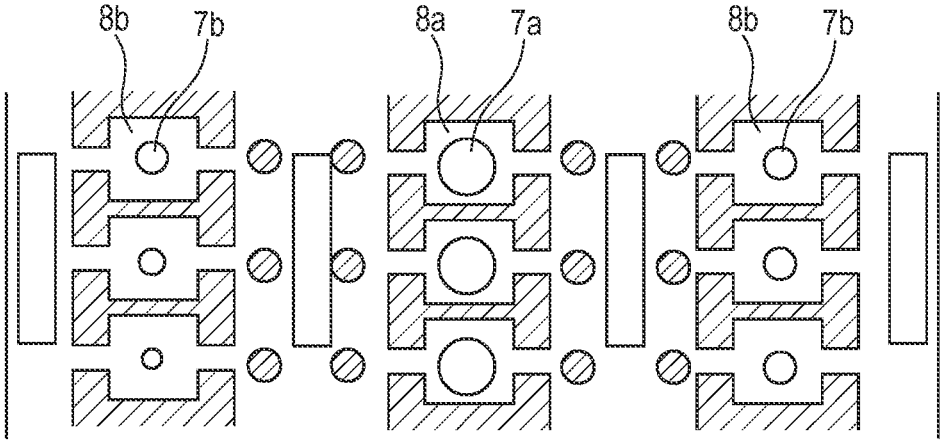
FIG. 8 is a schematic plan view illustrating an exemplary recording head in which the total amount of ink that flows out of intermediate pressure chambers is larger than the total amount of ink that flows out of both-end pressure chambers.

An exemplary structure which may adjust the amounts of ink which flows out of the intermediate pressure chambers 8*a* and the both-end pressure chambers 8*b* is one illustrated in FIG. 8. FIG. 8 is a schematic plan view illustrating an exemplary recording head in which the total amount of ink which flows out of the intermediate pressure chambers 8*a* is larger than the total amount of ink which flows out of the both-end pressure chambers 8*b*.

As illustrated in FIG. 8, the opening area of an ejection orifice which communicates the intermediate pressure chamber 8*a* to the atmosphere (hereinafter referred to as intermediate ejection orifice 7*a*) is larger than the opening area of an ejection orifice which communicates the both-end pressure chamber 8*b* to the atmosphere (hereinafter referred to as both-end ejection orifice 7*b*). Ink is more likely to flow from the intermediate ejection orifice 7*a* than from the both-end ejection orifice 7*b*, and the total amount of ink which flows out of the intermediate pressure chambers 8*a* is larger than the total amount of ink which flows out of the both-end pressure chambers 8*b*.

Figure 9:
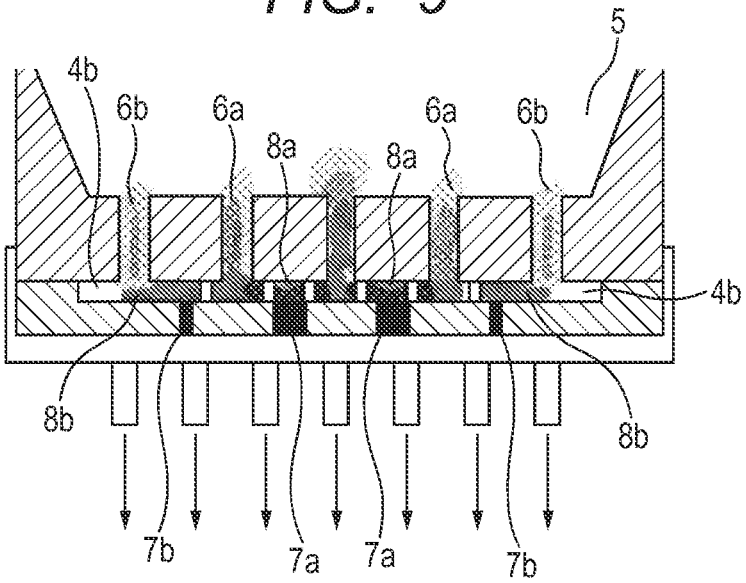
FIG. 9 is a sectional view of a recording head in which the opening area of an intermediate ejection orifice is larger than the opening area of a both-end ejection orifice.

FIG. 9 is a sectional view of a recording head in which the opening area of the intermediate ejection orifice 7*a* is larger than the opening area of the both-end ejection orifice 7*b*. FIG. 9 also illustrates the result of a simulation of flow velocity distribution of ink when ink is sucked from the intermediate ejection orifice 7*a* side or the both-end ejection orifice 7*b* side, and higher density represents higher flow velocity.

Comparison between the ink flow velocity distribution illustrated in FIG. 9 and the ink flow velocity distribution illustrated in FIG. 7B clarifies the following. The difference in flow velocity between ink which passes through the second supply opening 6*b* and ink which passes through the first supply opening 6*a* illustrated in FIG. 9 is larger than the difference in ink flow velocity illustrated in FIG. 7B. This is because the opening area of the both-end ejection orifice 7*b* is smaller than the opening area of the intermediate ejection orifice 7*a*, and the flow velocity of ink which flows out of the both-end pressure chamber 8*b* is lower than the flow velocity of ink which flows out of the intermediate pressure chamber 8*a*.

By reducing the flow velocity of ink which passes through the second supply opening 6*b*, more foreign matter in ink may be collected in the ink flow through the first supply openings. Therefore, without provision of the filter in the ink path from the second common liquid chamber 4*b* to the both-end pressure chamber 8*b*, inflow of foreign matter into the both-end pressure chamber 8*b* is more inhibited.

(Third Embodiment)

Figure 10:
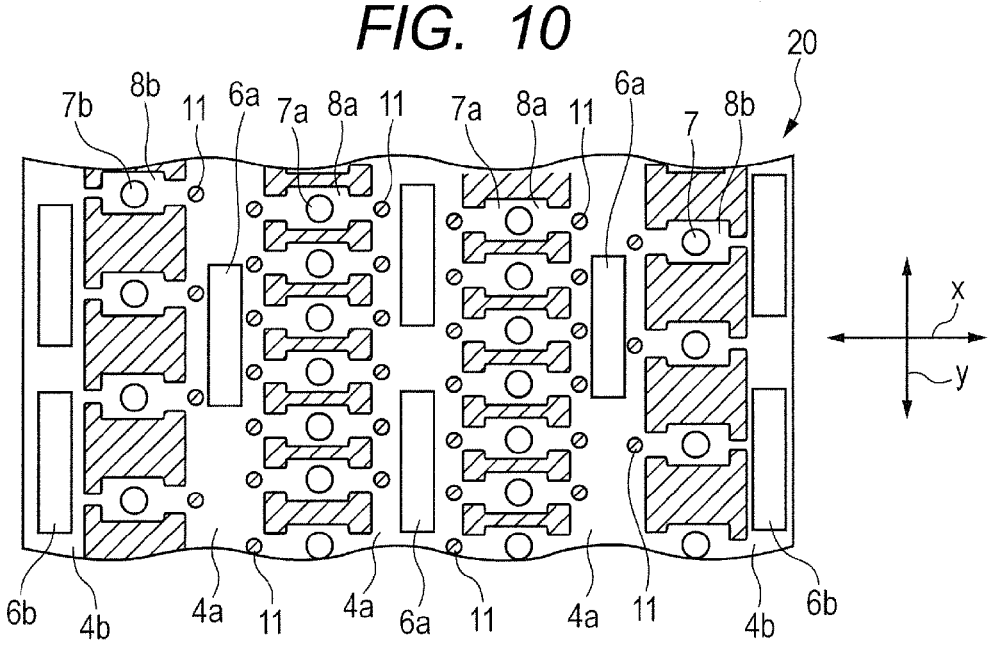
FIG. 10 is a schematic plan view of a recording head according to a third embodiment of the present invention.

A recording head according to the third embodiment of the present invention is described with reference to FIG. 10. FIG. 10 is a schematic plan view of the recording head according to this embodiment seen from a direction of ink ejection. Description of the same members as those in the first or second embodiment is omitted and only different members are described.

In the second embodiment, as illustrated in FIG. 8, by setting the opening area of the both-end ejection orifice 7*b* to be smaller than the opening area of the intermediate ejection orifice 7*a*, the difference in flow velocity between ink which passes through the first supply opening 6*a* and ink which passes through the second supply opening 6*b* is increased. In this embodiment, in order to set the total amount of ink which flows out of the both-end pressure chambers 8*b* to be smaller than the total amount of ink which flows out of the intermediate pressure chambers 8*a*, the number of the both-end pressure chambers 8*b* is smaller than the number of the intermediate pressure chambers 8*a* as illustrated in FIG. 10.

Specifically, in a recording head 20 illustrated in FIG. 10, the arrangement density of the both-end ejection orifices 7*b* (the number of the ejection orifices 7 arranged per unit length along the second direction Y) is lower than the arrangement density of the intermediate ejection orifices 7*a*. By increasing the arrangement density of the intermediate ejection orifices 7*a*, when ejecting operation or suction operation is carried out, more ink flows into the intermediate pressure chambers 8*a* to increase the flow velocity of ink which passes through the first supply openings 6*a*.

This is particularly effective in a recording head in which the opening area of the both-end ejection orifice 7*b* is required to be larger than the opening area of the intermediate ejection orifice 7*a*.

For example, consider a case where the opening area of the both-end ejection orifice 7*b* is approximately twice as large as the opening area of the intermediate ejection orifice 7*a* and an ink droplet ejected from the both-end ejection orifice 7*b* is approximately 10 pl while an ink droplet ejected from the intermediate ejection orifice 7*a* is approximately 5 pl. In this case, when the arrangement density of the both-end ejection orifices 7*b* is 300 dpi and the arrangement density of the intermediate ejection orifices 7*a* is 600 dpi, ink may be supplied to the intermediate pressure chambers 8*a* and the both-end pressure chambers 8*b* without increasing the amount of ink which passes through the second supply openings 6*b*.

Note that, when the opening area of the both-end ejection orifice 7*b* is larger, foreign matter passes through the both-end ejection orifice 7*b* together with ink, and thus, even when foreign matter flows into the both-end pressure chamber 8*b*, the foreign matter is less liable to clog the both-end ejection orifice 7*b*.

(Fourth Embodiment)

A recording head according to the fourth embodiment of the present invention is described with reference to FIGS. 11A and 11B.

Figure 11A:
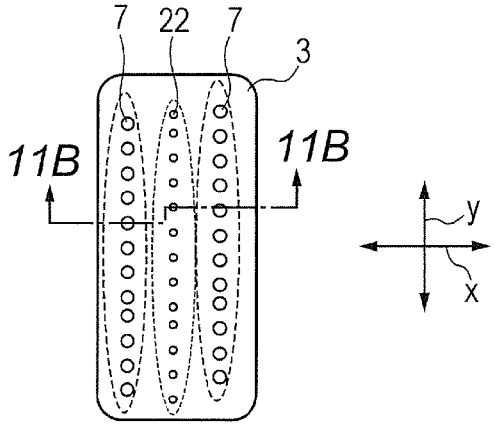
FIG. 11A is a plan view of an orifice plate in a recording head according to a fourth embodiment of the present invention.
Figure 11B:
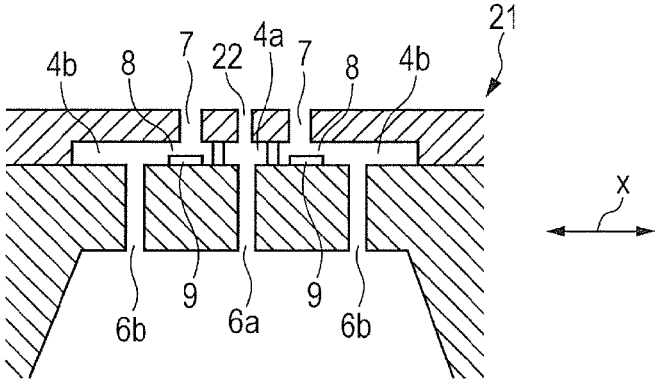
FIG. 11B is a sectional view of the recording head.

FIG. 11A is a plan view of the orifice plate 3 in the recording head according to this embodiment, and FIG. 11B is a sectional view of the recording head including the orifice plate 3 taken along the line 11B-11B of FIG. 11A. As illustrated in FIGS. 11A and 11B, the arrangement of the ejection orifices 7 and the pressure chambers 8 in a recording head 21 according to this embodiment is the same as that in the recording head 13 according to the first embodiment.

Suction holes 22 which communicate the first common liquid chambers 4*a* to the atmosphere and through which ink in the first common liquid chamber 4*a* may be sucked are formed in the orifice plate 3 at portions corresponding to the first common liquid chambers 4*a*. The suction hole 22 does not communicate to the pressure chamber 8, and the suction hole 22 does not contribute to ink ejection.

With regard to suction operation of ink from a surface of the orifice plate 3, as the opening area of an opening communicating the substrate 2 through the orifice plate 3 to the atmosphere becomes larger, more ink flows out of the pressure chamber 8.

In this embodiment, the suction holes 22 communicate the first common liquid chambers 4*a* to the atmosphere, and thus, when suction operation of ink from the surface of the orifice plate 3 is carried out, ink is sucked from the first common liquid chambers 4*a* via the suction holes 22. Therefore, more ink is supplied from the first supply opening 6*a* to the first common liquid chamber 4*a*, and the flow velocity of ink which passes through the first supply opening 6*a* is higher than the flow velocity of ink which passes through the second supply opening 6*b*.

Further, similarly to the second or third embodiment, this embodiment is not limited to the recording head illustrated in FIGS. 11A and 11B, and similar effects may be obtained with regard to a recording head in which three or more ejection orifices 7 are arranged along the first direction X. Exemplary recording heads include the one illustrated in FIGS. 12A and 12B.

Figure 12A:
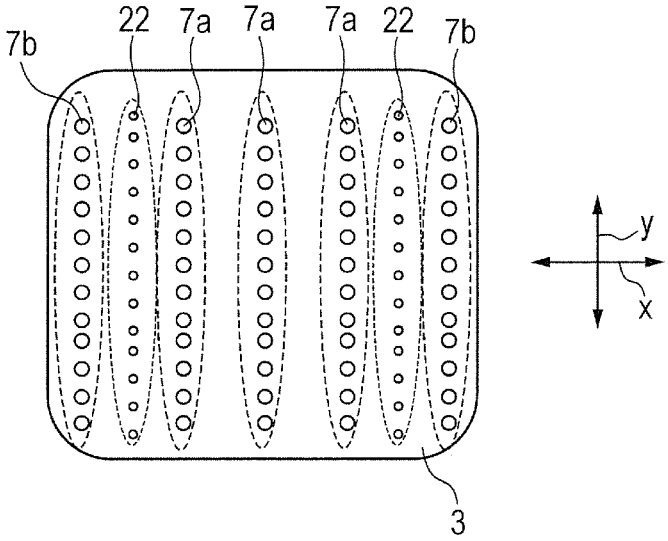
FIGS. 12A and 12B are plan views each illustrating an exemplary orifice plate of a recording head having three or more ejection orifices side by side along a predetermined direction to which the fourth embodiment is applied.
Figure 12B:
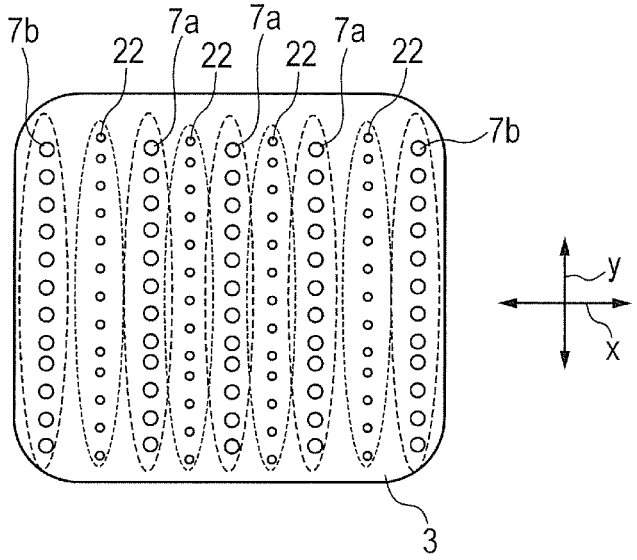

FIGS. 12A and 12B are plan views each illustrating an exemplary orifice plate of a recording head having three or more ejection orifices 7 side by side along the first direction X to which this embodiment is applied. As illustrated in FIG. 12A, the suction holes 22 may be formed only between the both-end ejection orifices 7*b* and the intermediate ejection orifices 7*a* which are side by side along the first direction X. Alternatively, as illustrated in FIG. 12B, the suction holes 22 may be formed also between the intermediate ejection orifices 7*a* which are side by side along the first direction X.

The shape, number, and size of the suction holes 22 are not limited to those illustrated in FIGS. 11A and 11B and FIGS. 12A and 12B. It is enough that ink is adapted to flow out of the first common liquid chamber 4*a* through the suction hole 22 and ink is adapted not to be ejected from the suction hole 22 when ejection energy is given from the energy generating element 9 to ink in the pressure chamber 8.

(Fifth Embodiment)

A recording head according to the fifth embodiment of the present invention is described with reference to FIGS. 13A to 13C. Note that, in FIGS. 13A to 13C, like reference symbols are used to designate like members in the first to fourth embodiments and description thereof is omitted, and only different members are described.

Figure 13A:
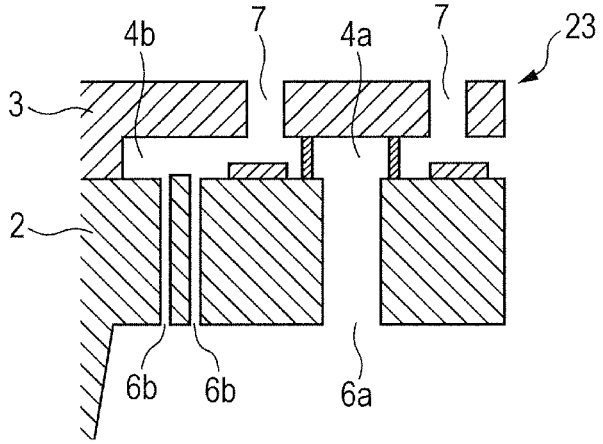
FIG. 13A is a sectional view of a recording head according to a fifth embodiment of the present invention.

FIG. 13A is a sectional view of the recording head according to the fifth embodiment. FIG. 13B is a perspective view of flow paths communicating between the first and second supply openings 6*a* and 6*b* and the first and second common liquid chambers 4*a* and 4*b*, respectively, illustrated in FIG. 13A. FIG. 13C is a development view of the flow paths illustrated in FIG. 13B.

In the recording heads according to the second to fourth embodiments, the ink flow velocity distribution is changed by the characteristic structures of the orifice plate 3. In a recording head 23 according to this embodiment, the ink flow velocity distribution is changed by changing the sizes of the first and second supply openings 6*a* and 6*b*.

Specifically, according to this embodiment, the area of the second supply opening 6*b* is smaller than the area of the first supply opening 6*a*. Therefore, the cross-sectional area of the flow path communicating between the second supply opening 6*b* and the second common liquid chamber 4*b* which is perpendicular to the ink flow direction (hereinafter simply referred to as cross-sectional area) is smaller than the cross-sectional area of the flow path communicating between the first supply opening 6*a* and the first common liquid chamber 4*a*.

In the recording head 23 illustrated in FIG. 13A, two second supply openings 6*b* are formed. It is desired that the recording head 23 be formed so that the following equation holds:

$$\int\{\int(\pi r1^2)dz+\int(\pi r2^2)dz\}\leq\iint(\pi r3^2)dz \quad \text{(Eq. 1)}$$

Figure 13B:
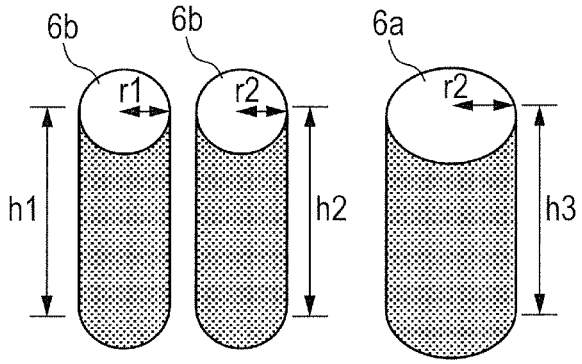
FIGS. 13B and 13C are a perspective view and a development view, respectively, of flow paths communicating between first and second supply openings and first and second common liquid chambers, respectively.

Note that, in deriving Equation 1, as illustrated in FIG. 13B, the first and second supply openings 6*a* and 6*b* are in the shape of a circle and the flow paths which communicate between the first and second supply openings 6*a* and 6*b* and the first and second common liquid chambers 4*a* and 4*b*, respectively, are in the shape of a circular cylinder. Further, the radii of the two second supply openings 6*b* are represented by r1 and r2, respectively, the distances from the two second supply openings 6*b* to the second common liquid chamber 4*b* are represented by h1 and h2, respectively, the radius of the first supply opening 6*a* is represented by r3, and the distance from the first supply opening 6*a* to the first common liquid chamber 4*a* is represented by h3.

Equation 1 expresses that the total cross-sectional area of the flow paths which communicate the second supply openings 6*b* to the second common liquid chamber 4*b* is equal to or smaller than the cross-sectional area of the flow path which communicates the first supply opening 6*a* to the first common liquid chamber 4*a*. By forming the recording head 23 so that Equation 1 holds, the flow resistance value of ink which passes through the second supply opening 6*b* is prevented from being too small. By increasing the flow resistance value, the difference in flow velocity between ink which passes through the second supply opening 6*b* and ink which passes through the first supply opening 6*a* is further increased.

Further, in order to more increase the flow resistance value of ink which passes through the second supply opening 6*b*, it is better that the surface areas of the flow paths which communicate between the second supply openings 6*b* and the second common liquid chamber 4*b* be larger than the surface area of the flow path which communicates between the first supply opening 6*a* and the first common liquid chamber 4*a*. In other words, it is desired that the recording head 23 be formed so that both Equation 1 and the following equation are satisfied:

$$\int\{2\pi r1\times h1+2\pi r2\times h2\}>\int 2\pi r3\times h3 \quad \text{(Eq. 2)}$$

Figure 13C:
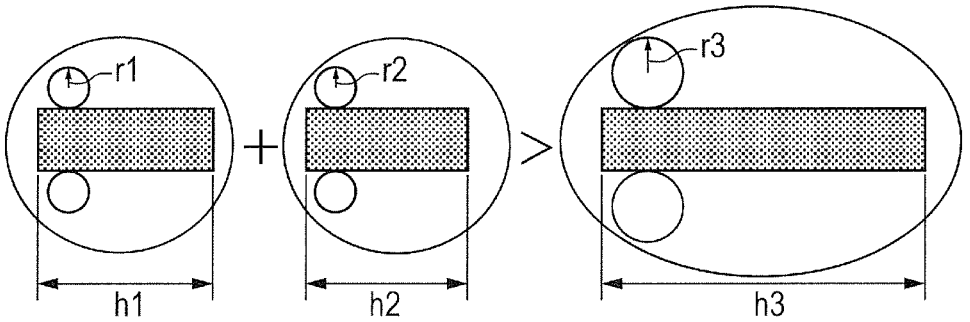

Equation 2 may be expressed by means of the surface areas of the respective flow paths in a development view as illustrated in FIG. 13C.

As the total cross-sectional area of the flow paths becomes smaller and as the total surface area of the flow paths becomes larger, the flow resistance value becomes larger and ink is less likely to flow. Specifically, in the recording head 23 which satisfies Equations 1 and 2, the difference in flow velocity between ink which passes through the second supply opening 6*b* and ink which passes through the first supply opening 6*a* may be further increased, and foreign matter is less likely to pass through the second supply openings 6*b*.

By reducing foreign matter which passes through the second supply openings 6*b*, without provision of the filter 11 in the ink paths from the second common liquid chambers 4*b* to the pressure chamber 8, inflow of foreign matter 17 into the pressure chamber 8 is inhibited.

(Sixth Embodiment)

A recording head according to the sixth embodiment of the present invention is described with reference to FIG. 14.

Figure 14:
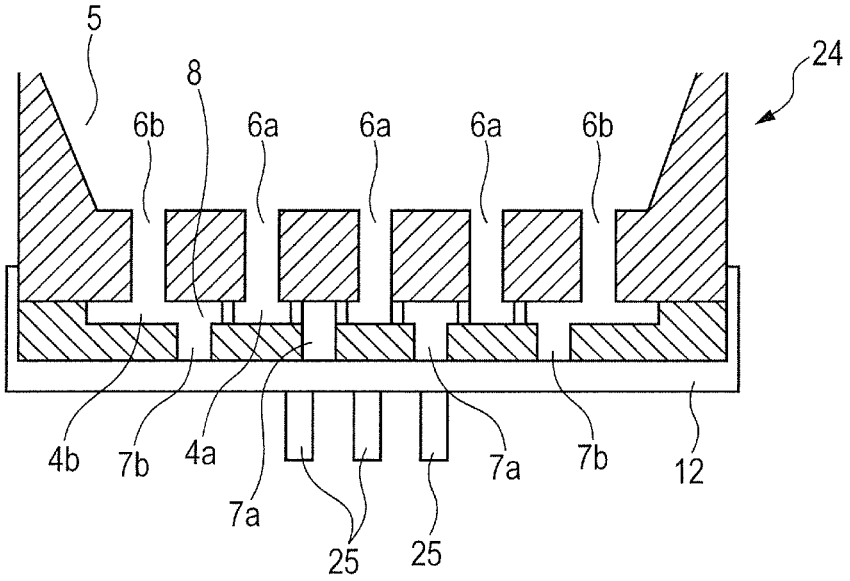
FIG. 14 is a sectional view of a recording head according to a sixth embodiment of the present invention.

FIG. 14 is a sectional view of the recording head according to this embodiment, and illustrates a state in which a suction cap 12 is mounted onto the recording head.

For the purpose of performing recovery from ejection failure of a recording head 24 according to this embodiment and filling ink into the pressure chambers 8, the suction cap 12 covers the surface of the orifice plate 3 and sucks ink from the ejection orifices 7 by reducing the pressure in the pressure chambers 8. When the suction holes 22 (see FIGS. 11A and 11B) are formed in the orifice plate 3, ink is sucked also from the suction holes 22.

As a pressure reducing unit, a motor and a tube are used, but here, the pressure reducing unit is not specifically referred to, and any pressure reducing unit may be used.

The suction cap 12 includes ink suction paths 25. When pressure around the ink suction paths 25 is reduced, ink is sucked out from the ejection orifices 7. In this embodiment, the ink suction paths 25 are not provided near the both-end ejection orifices 7*b*, but are provided near the intermediate ejection orifices 7*a*.

The amount of ink sucked from the ejection orifices near the ink suction paths 25, that is, from the intermediate ejection orifices 7*a* is larger than the amount of ink sucked from the ejection orifices relatively far from the ink suction paths 25, that is, from the both-end ejection orifices 7*b*.

The reduced amount of ink sucked from the both-end ejection orifices 7*b* further increases the difference in flow velocity between ink which passes through the second supply opening 6*b* and ink which passes through the first supply opening 6*a*, and thus, foreign matter becomes further less liable to pass through the second supply openings 6*b*. As a result, without provision of the filter 11 in the ink path from the second common liquid chamber 4*b* to the pressure chamber 8, inflow of the foreign matter 17 into the pressure chamber 8 is inhibited.

The suction cap 12 illustrated in FIG. 14 is only exemplary in this embodiment, and the shape, arrangement, number, and the like of the ink suction paths 25 are not limited to those illustrated in FIG. 14. Further, other than the suction cap 12 in which the ink suction paths 25 are provided only near the intermediate ejection orifices 7*a*, the following suction caps may obtain similar effects.

Exemplary suction caps include a suction cap which includes the ink suction paths 25 near the both-end ejection orifices 7*b* but in which the diameter of the ink suction paths 25 near the both-end ejection orifices 7*b* is smaller than the diameter of the ink suction paths 25 near the intermediate ejection orifices 7*a* or in which the number of the ink suction paths 25 near the both-end ejection orifices 7*b* is smaller than the number of the ink suction paths 25 near the intermediate ejection orifices 7*a*, and a suction cap in which the suction time of the ink suction paths 25 near the both-end ejection orifices 7*b* is set to be shorter than the suction time of the ink suction paths 25 near the intermediate ejection orifices 7*a*.

(Seventh Embodiment)

A recording head according to the seventh embodiment of the present invention is described with reference to FIGS. 15A to 15C.

Figure 15A:
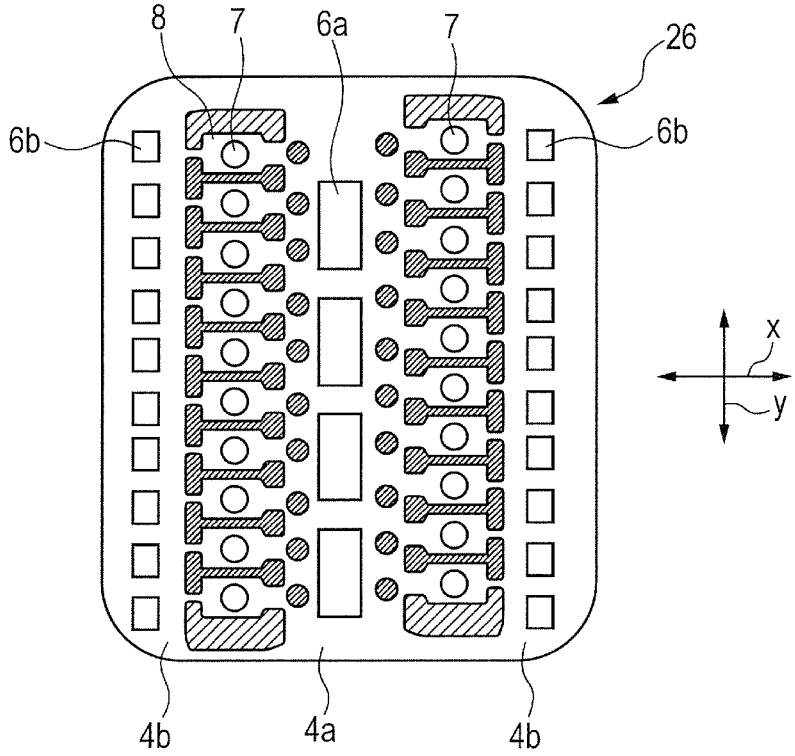
FIG. 15A is a schematic plan view of a recording head according to a seventh embodiment of the present invention.

FIG. 15A is a schematic plan view of the recording head according to this embodiment seen from a direction of ink ejection. FIG. 15B is a partial enlarged view of FIG. 15A.

Figure 15B:
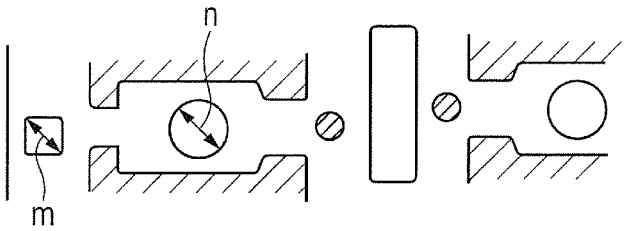
FIGS. 15B and 15C are enlarged views of the recording head.
Figure 15C:
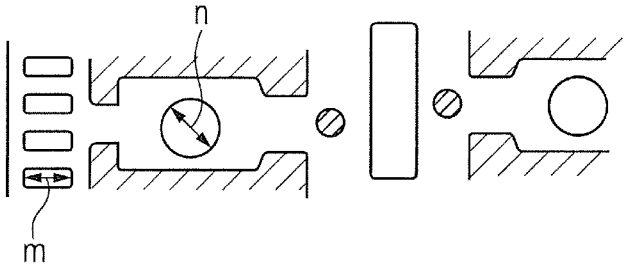

As illustrated in FIGS. 15A to 15C, in a recording head 26 according to this embodiment, the second supply openings 6*b* are in a rectangular shape, and the ejection orifices 7 are in a circular shape. A length m of a diagonal line across the second supply opening 6*b* is smaller than a diameter n of the ejection orifice 7 which communicates between the pressure chamber 8 and the atmosphere, the pressure chamber 8 communicating to the second common liquid chamber 4*b*.

The length m of the diagonal line is smaller than the diameter n, and thus, foreign matter in ink which does not pass through the ejection orifice 7 but remains in the pressure chamber 8 to cause ejection failure does not pass through the second supply opening 6*b*. In other words, the second supply openings 6*b* have the effect of trapping foreign matter.

According to this embodiment, foreign matter does not pass through the second supply openings 6*b*, and thus, without provision of the filter 11 in the ink path from the second common liquid chamber 4*b* to the pressure chamber 8, foreign matter which may cause clogging of the ejection orifice 7 is prevented from flowing into the pressure chamber 8.

Even when the second supply opening 6*b* has such a structure, almost no foreign matter clogs the second supply opening 6*b*. The reason is that the flow velocity of ink which passes through the first supply opening 6*a* is relatively high, and thus, foreign matter which is liable to clog the second supply opening 6*b* flows toward the first supply opening 6*a*.

Suppose that a structure similar to that of the second supply opening 6*b* according to this embodiment is applied to the first supply opening 6*a*. Then, a relatively large amount of foreign matter passes through the first supply opening 6*a*, and thus, the possibility that the first supply opening 6*a* itself is clogged becomes very high.

In the recording head 26 illustrated in FIGS. 15A to 15C, only two ejection orifices 7 are arranged along the first direction X, but similar effects may be obtained with regard to a recording head in which three or more ejection orifices are arranged along the first direction X. Further, the shape of the second supply opening 6*b* is not limited to a rectangle, and may be in a circular shape, in an oval shape, or further, in the shape of a slit as illustrated in FIG. 15C.

(Eighth Embodiment)

A recording head according to the eighth embodiment of the present invention is described with reference to FIGS. 16A and 16B.

Figure 16A:
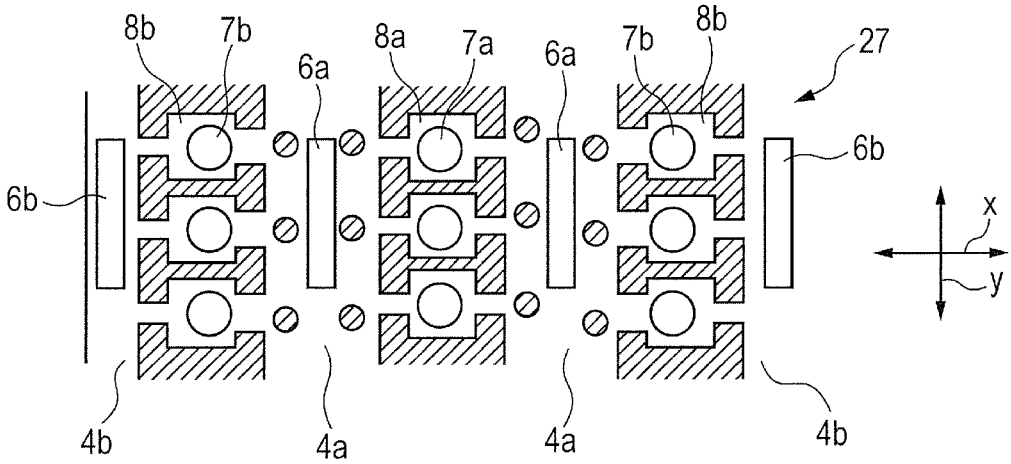
FIGS. 16A and 16B are schematic plan views of recording heads according to an eighth embodiment of the present invention.
Figure 16B:
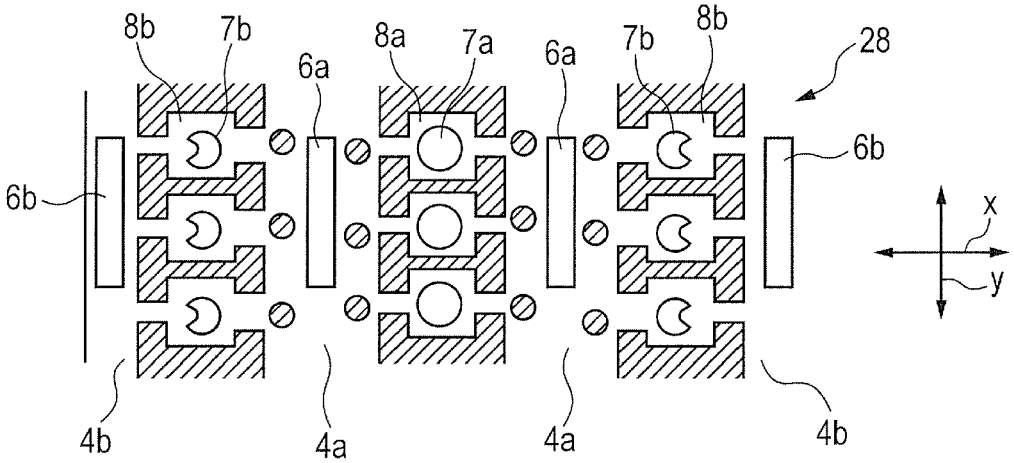

FIGS. 16A and 16B are schematic plan views of the recording heads according to this embodiment seen from a direction of ink ejection. As illustrated in FIGS. 16A and 16B, the both-end ejection orifices 7*b* of the recording heads according to this embodiment are offset to the first common liquid chamber 4*a* side with respect to the center of the both-end pressure chambers 8*b*.

Specifically, the both-end ejection orifice 7*b* of a recording head 27 illustrated in FIG. 16A is in a circular shape, and the center of the both-end ejection orifice 7*b* is offset to the first common liquid chamber 4*a* side with respect to the center of the both-end pressure chamber 8*b*. In a recording head 28 illustrated in FIG. 16B, the shape of the both-end ejection orifice 7*b* lacks the circular-shaped second common liquid chamber 4*b* side.

By forming the both-end ejection orifice 7*b* to be offset to the first common liquid chamber 4*a* side with respect to the center of the both-end pressure chamber 8*b*, the flow resistance value from the first supply opening 6*a* to the both-end ejection orifice 7*b* becomes lower than the flow resistance value from the second supply opening 6*b* to the both-end ejection orifice 7*b*. Therefore, when ejecting operation or suction operation is carried out, more ink flows through the first supply opening 6*a*.

The difference in flow velocity between ink which passes through the second supply opening 6*b* and ink which passes through the first supply opening 6*a* is further increased, and thus, foreign matter is more likely to pass through the first supply opening 6*a*. Therefore, without provision of the filter in the ink paths from the second common liquid chambers 4*b* to the both-end pressure chambers 8*b*, almost no foreign matter flows into the both-end pressure chambers 8*b*.

With regard to the both-end ejection orifice 7*b* according to this embodiment, the shape and the location are not limited to those illustrated in FIGS. 16A and 16B insofar as the both-end ejection orifice 7*b* is offset to the first common liquid chamber 4*a* side with respect to the center of the both-end pressure chamber 8*b*. The shape of the both-end ejection orifice 7*b* may be, for example, in a rectangular shape, in a protruding shape, in an oval shape, in the shape of a slit, and the size thereof is not limited.

(Ninth Embodiment)

A recording method for a recording head as a ninth embodiment of the present invention is described with reference to FIGS. 17 and 18.

Figure 17:
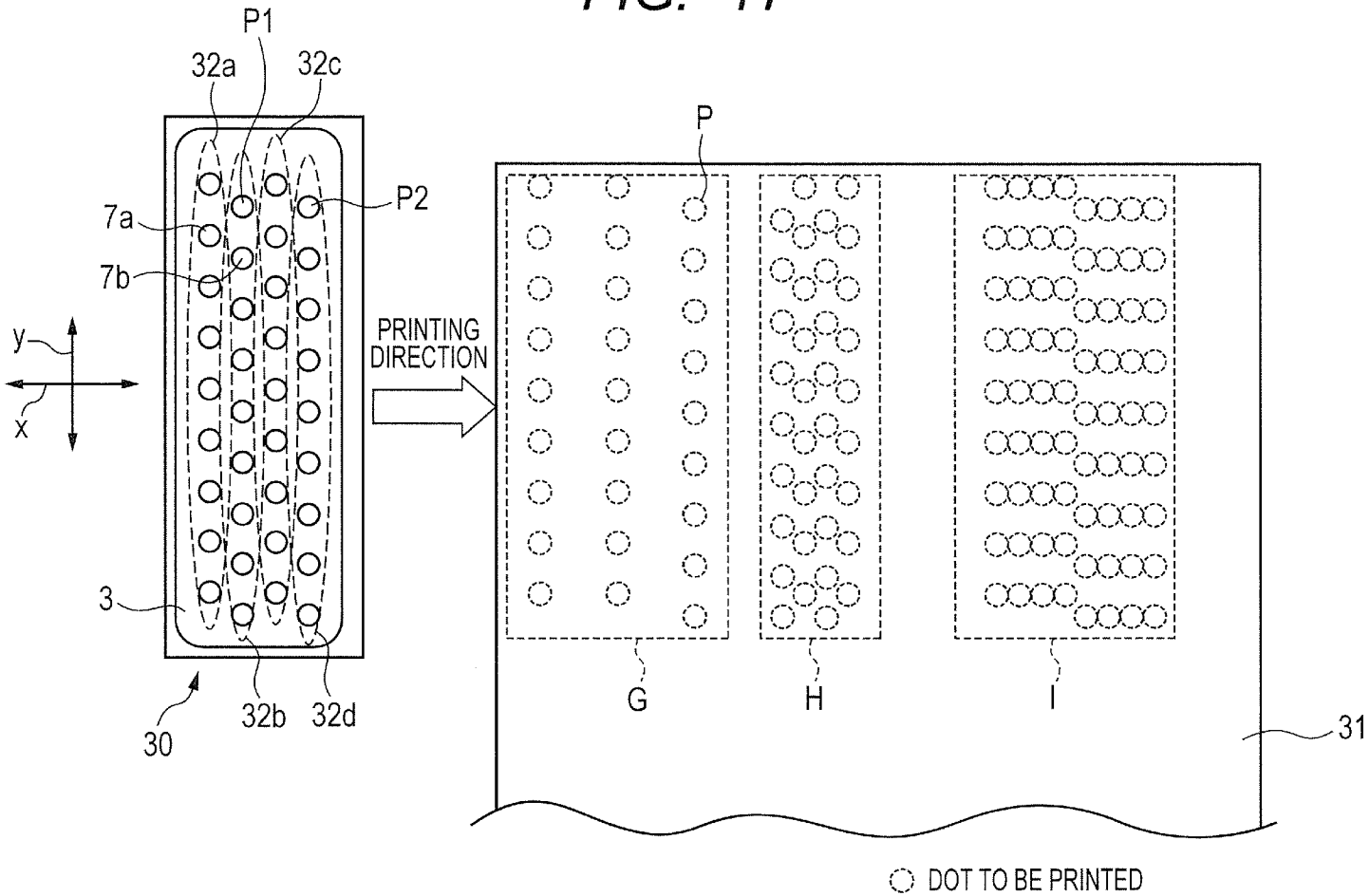
FIG. 17 is an explanatory view of how a recording head uses multiple ejection orifices to carry out printing of various printing patterns.

FIG. 17 is an explanatory view of how the recording head uses the multiple ejection orifices 7 to carry out printing of various printing patterns. Note that, in a recording head 30 according to this embodiment, four ejection orifices 7 which may eject substantially the same amount of ink of the same color are arranged along the first direction X, and the recording head 30 moves above a recording medium 31 along the first direction X.

Figure 18:
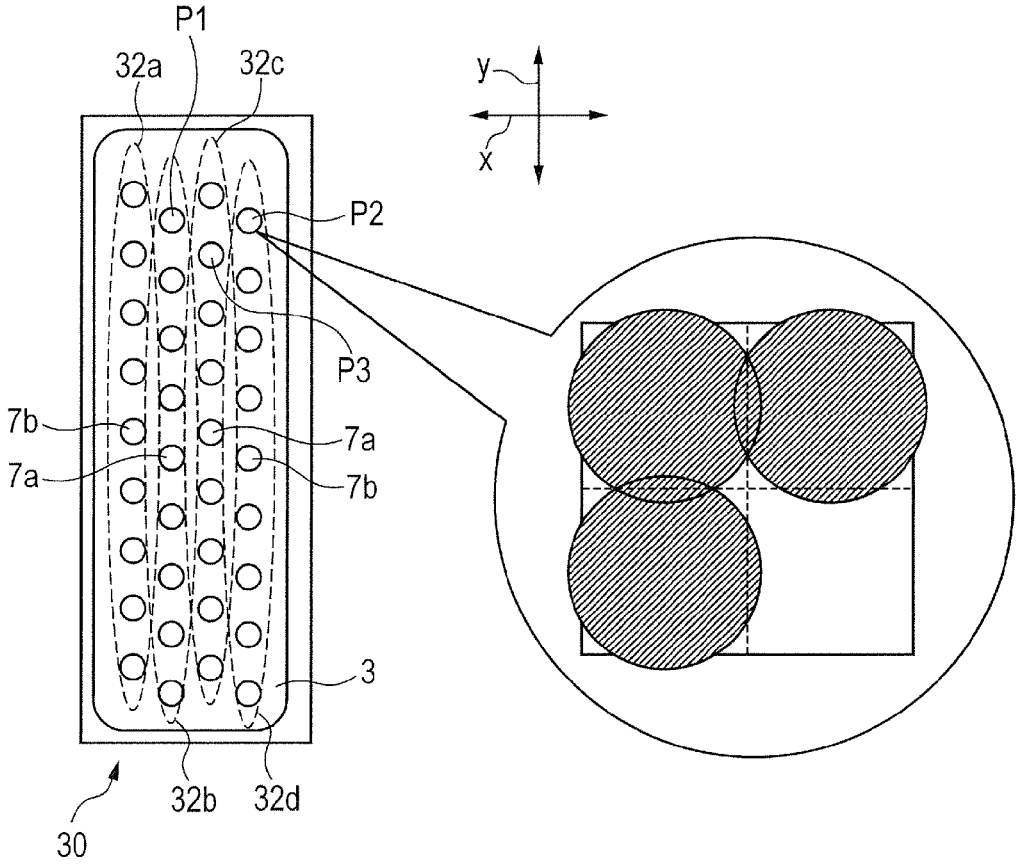
FIG. 18 is an explanatory view of a recording method for increasing the density of an image to be recorded on a recording medium.
Figure 19A:
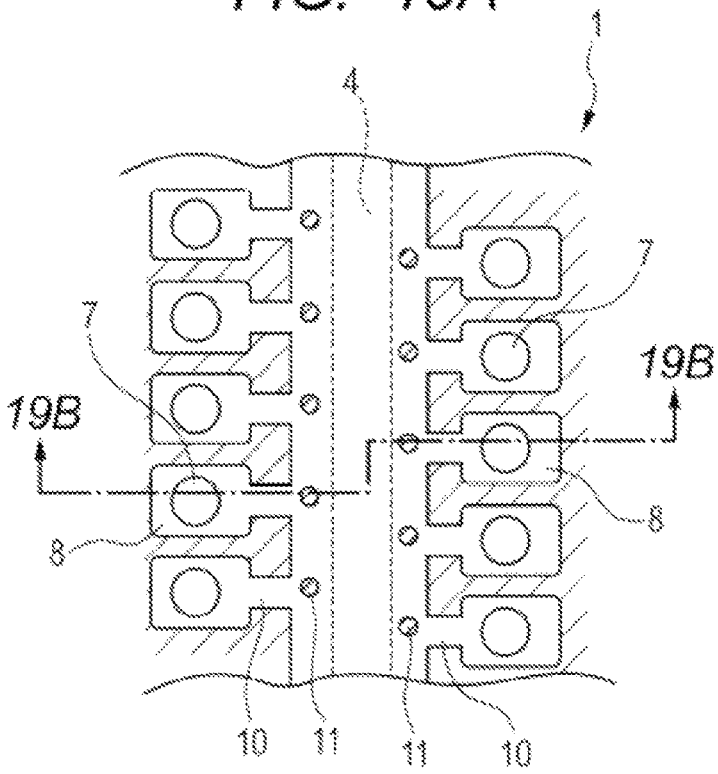
PRIOR ART FIG. 19A
FIG. 19A is a schematic plan view of a related recording head seen from a direction of ink ejection.
Figure 19B:
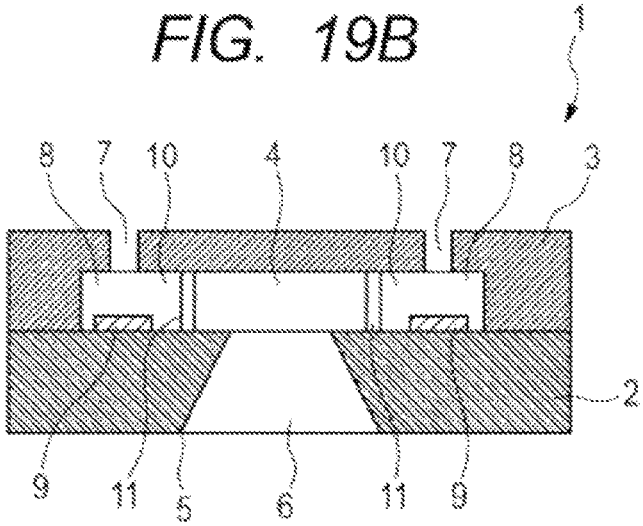
PRIOR ART FIG. 19B
FIG. 19B is a sectional view of the recording head.
Figure 20A:
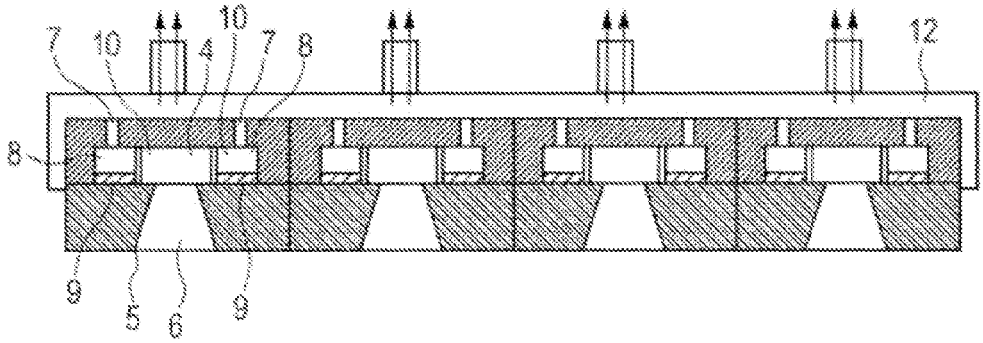
PRIOR ART FIG. 20A
FIGS. 20A and 20B are sectional views of a recording head having multiple common liquid chambers and supply openings.
Figure 20B:
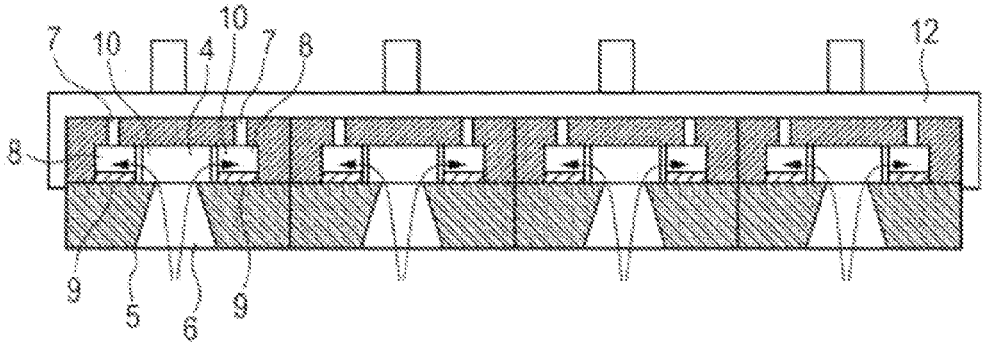
PRIOR ART FIG. 20B

FIG. 18 is an explanatory view of a recording method for increasing the density of an image to be recorded on the recording medium 31.

As illustrated in FIG. 17, rows of the ejection orifices 7 in each of which the ejection orifices 7 are arranged in a Y direction are referred to as ejection orifice rows 32*a*, 32*b*, 32*c*, and 32*d* in this order from left to right in the drawing. The ejection orifice rows 32*b* and 32*c* are formed of the intermediate ejection orifices 7*a*, while the ejection orifice rows 32*a* and 32*d* are formed of the both-end ejection orifices 7*b*.

The ejection orifices 7 of the ejection orifice rows 32*a* and 32*c* may eject ink to the same locations on the recording medium 31, and the ejection orifices 7 of the ejection orifice rows 32*b* and 32*d* may eject ink to the same locations on the recording medium 31. For example, a dot P on the recording medium 31 may be printed by both an ejection orifice P1 of the ejection orifice row 32*b* and an ejection orifice P2 of the ejection orifice row 32*d*.

Regions G, H, and I in the recording medium 31 represent different printing patterns, and dotted circles represent regions on which ink droplets are desired to be landed (dots).

When the dots are relatively away from one another with respect to the printing direction and the dots are not joined together as in the regions G and H, the ejection orifices 7 which form the ejection orifice rows 32*b* and 32*c* are heavily used to carry out printing.

When the dots are joined together and printing is carried out at an ejection frequency equal to or higher than the refill frequency of one pressure chamber 8 as in the region H, it is effective to uniformly use all the ejection orifices 7 which form the ejection orifice rows 32*a*, 32*b*, 32*c*, and 32*d* to carry out printing.

Even when the dots are joined together, if the printing speed is low or printing is carried out under a state in which the recording head 30 scans multiple times, printing may be carried out at an ejection frequency lower than the refill frequency of one pressure chamber 8, and thus, it is preferred to heavily use the ejection orifices 7 which form the ejection orifice rows 32*b* and 32*c*.

Note that, to "heavily use" as used herein does not mean carrying out all the printing by ejecting ink from the ejection orifice rows 32*b* and 32*c*, but means that the number of ink ejections from the ejection orifice rows 32*b* and 32*c* is larger than the number of ink ejections from the ejection orifice rows 32*a* and 32*d*. This is because the ejection orifice rows 32*b* and 32*c* cannot always carry out all the printing in relation to the lifetime of the energy generating elements 9 (FIGS. 1A and 1B).

By heavily using the ejection orifice rows 32*b* and 32*c* formed of the intermediate ejection orifices 7*a* to carry out printing, the difference in flow velocity between ink which passes through the first supply opening 6*a* (FIGS. 7A and 7B) and ink which passes through the second supply opening 6*b* (FIGS. 7A and 7B) is further increased. Therefore, almost no foreign matter passes through the second supply opening 6*b*, and, without provision of the filter in the ink paths from the second common liquid chambers 4*b* to the both-end pressure chambers 8*b* (FIGS. 7A and 7B), inflow of foreign matter into the both-end pressure chambers 8*b* is more inhibited.

Further, also when the number of ejections into a cell of a predetermined size is increased so that the density of an image to be recorded on the recording medium 31 becomes higher, the intermediate ejection orifices 7*a* which form the ejection orifice rows 32*b* and 32*c* are heavily used. Specifically, as illustrated in FIG. 18, the ejection orifices P1, P2, and P3, that is, two intermediate ejection orifices 7*a* and one both-end ejection orifice 7*b*, are used.

Such usage of the recording head in which the intermediate ejection orifices 7*a* forming the ejection orifice rows 32*b* and 32*c* are heavily used is effective also in preliminary ejecting operation for preventing ejection failure and for improving initial ejection property. The preliminary ejecting operation is to move the recording head to a position unrelated to printing, to carry out ejecting operation, and to refresh ink in the pressure chamber 8 whose amount of moisture is reduced and whose viscosity is increased.

Also in the preliminary ejecting operation, by increasing the total number of ejections from the intermediate ejection orifices 7*a*, the difference in flow velocity between ink which passes through the first supply opening 6*a* (FIGS. 7A and 7B) and ink which passes through the second supply opening 6*b* (FIGS. 7A and 7B) is further increased. As a result, almost no foreign matter passes through the second supply opening 6*b*, and, without provision of the filter in the ink paths from the second common liquid chambers 4*b* to the both-end pressure chambers 8*b* (FIGS. 7A and 7B), inflow of foreign matter into the both-end pressure chambers 8*b* is more inhibited.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-264526, filed Dec. 2, 2011, which is hereby incorporated by reference herein in its entirety.

What is claimed is:

1. A liquid ejection head, comprising:

a substrate provided with an energy generating element for generating energy used for ejecting liquid;

a pressure chamber formed on a first surface side of the substrate having the energy generating element formed thereon, the pressure chamber communicating with an ejection orifice for ejecting liquid;

a first common liquid chamber formed on the first surface side of the substrate, for supplying liquid to the pressure chamber;

a filter formed between the pressure chamber and the first common liquid chamber, for inhibiting inflow of foreign matter in liquid supplied to the pressure chamber;

a second common liquid chamber formed on a side opposite to the side on which the first common liquid chamber is formed with respect to the pressure chamber, for supplying liquid to the pressure chamber;

a first supply opening formed in a second surface which is on an opposite side to the first surface of the substrate, the first supply opening communicating with the first common liquid chamber;

a second supply opening formed in the second surface of the substrate, the second supply opening communicating with the second common liquid chamber; and a liquid receiving portion formed in the second surface of the substrate so as to communicate with both the first supply opening and the second supply opening, the liquid receiving portion receiving liquid from outside of the substrate, wherein the second common liquid chamber, the pressure chamber, and the first common liquid chamber are arranged in this order in a first direction from an end of the substrate to a center of the substrate, and wherein the first common liquid chamber communicates with the pressure chamber via the filter, and the second common liquid chamber communicates with the pressure chamber through no filter.

2. The liquid ejection head according to claim 1, wherein a flow path width of a flow path which communicates between the second common liquid chamber and the pressure chamber is smaller than a flow path width of a flow path which communicates between the first common liquid chamber and the pressure chamber.

3. The liquid ejection head according to claim 1, further comprising at least one suction hole which allows liquid in the first common liquid chamber to be sucked therethrough.

4. The liquid ejection head according to claim 1, wherein a plurality of the second supply openings communicate with one second common liquid chamber, wherein a total cross-sectional area of flow paths which communicate the plurality of the second supply openings with the second common liquid chamber is equal to or smaller than a cross-sectional area of a flow path which communicates the first supply opening with the first common liquid chamber, and wherein a total surface area of the flow paths which communicate the plurality of the second supply openings with the second common liquid chamber is larger than a surface area of the flow path which communicates the first supply opening with the first common liquid chamber.

5. The liquid ejection head according to claim 1, wherein the ejection orifice is in a circular shape, the second supply opening is in a rectangular shape, and a length of a longest diagonal line across the second supply opening is smaller than a diameter of the ejection orifice which communicates with the pressure chamber communicating with the second supply opening.

6. The liquid ejection head according to claim 1, wherein at least three pressure chambers are formed along the first direction, and wherein a total amount of liquid ejected from both end pressure chambers located on end sides of the at least three pressure chambers in the first direction is smaller than a total amount of liquid ejected from intermediate pressure chambers which are not located on the end sides of the at least three pressure chambers in the first direction.

7. The liquid ejection head according to claim 6, wherein a total opening area of end ejection orifices communicating with both end pressure chambers is smaller than a total opening area of intermediate ejection orifices communicating with intermediate pressure chambers.

8. The liquid ejection head according to claim 1, further comprising:

multiple end pressure chambers; and multiple intermediate pressure chambers, wherein the multiple end pressure chambers are arranged along a second direction which intersects the first direction, wherein the multiple intermediate pressure chambers are arranged along the second direction, and wherein an arrangement density in an end pressure chamber row of the multiple end pressure chambers is lower than an arrangement density in an intermediate pressure chamber row of the multiple intermediate pressure chambers.

9. The liquid ejection head according to claim 1, further comprising:

multiple end pressure chambers; and multiple intermediate pressure chambers, wherein the multiple end pressure chambers are arranged along a second direction which intersects the first direction, wherein the multiple intermediate pressure chambers are arranged along the second direction, and wherein the number of the end pressure chambers arranged along the second direction is smaller than the number of the intermediate pressure chambers arranged along the second direction.

10. The liquid ejection head according to claim 1, wherein at least three pressure chambers are formed along the first direction, and wherein the ejection orifice communicating with the pressure chamber located on an end side in the first direction is offset toward a common liquid chamber side in the first direction with respect to a center of the pressure chamber.

* * * * *